US007743561B1

(12) United States Patent
Frederick

(10) Patent No.: US 7,743,561 B1
(45) Date of Patent: Jun. 29, 2010

(54) EAVES TROUGH

(76) Inventor: Michael J. Frederick, 3120 Fawn La., Jackson, MI (US) 49201

( * ) Notice: Subject to any disclaimer, the term of this patent is extended or adjusted under 35 U.S.C. 154(b) by 0 days.

(21) Appl. No.: 12/170,667

(22) Filed: Jul. 10, 2008

(51) Int. Cl.
*E04D 13/064* (2006.01)

(52) U.S. Cl. ..... 52/11; 52/12; 52/16; 248/48.1

(58) Field of Classification Search ..... 52/11, 52/12, 16; 248/48.1, 48.2; 210/162
See application file for complete search history.

(56) References Cited

U.S. PATENT DOCUMENTS

| | | | | | |
|---|---|---|---|---|---|
| 406,233 | A | * | 7/1889 | Phelps | 52/12 |
| 603,611 | A | * | 5/1898 | Nye | 52/12 |
| 836,012 | A | | 11/1906 | Cassen | |
| 870,165 | A | | 11/1907 | Hagler et al. | |
| 891,405 | A | * | 6/1908 | Cassens | 210/474 |
| 2,537,243 | A | * | 1/1951 | Swartz | 52/12 |
| 2,569,568 | A | | 10/1951 | Lipshaw | |
| 2,672,832 | A | | 3/1954 | Goetz | |
| 2,873,700 | A | | 2/1959 | Heier | |
| 2,988,226 | A | | 6/1961 | Campbell | |
| 3,388,555 | A | * | 6/1968 | Foster | 405/119 |
| 4,404,775 | A | | 9/1983 | Demartini | |
| 4,435,925 | A | | 3/1984 | Jefferys | |
| 4,461,128 | A | * | 7/1984 | Knoebl | 52/94 |
| 4,497,146 | A | | 2/1985 | Demartini | |
| 4,571,896 | A | | 2/1986 | Condie | |
| 4,581,857 | A | * | 4/1986 | Harbom | 52/12 |
| 4,858,396 | A | * | 8/1989 | Rose et al. | 52/11 |
| 5,444,954 | A | * | 8/1995 | Anderson | 52/288.1 |
| 5,519,969 | A | * | 5/1996 | Golba | 52/60 |
| 5,634,314 | A | * | 6/1997 | Champagne | 52/712 |
| 5,675,955 | A | * | 10/1997 | Champagne | 52/521 |
| 5,829,206 | A | * | 11/1998 | Bachman | 52/94 |
| 5,836,113 | A | * | 11/1998 | Bachman | 52/94 |
| 6,035,587 | A | | 3/2000 | Dressler | |
| 6,161,338 | A | * | 12/2000 | Kuhns | 52/12 |
| 6,205,715 | B1 | * | 3/2001 | Rex, Jr. | 52/12 |
| 6,272,797 | B1 | * | 8/2001 | Finger | 52/94 |
| 6,625,941 | B2 | * | 9/2003 | Shaw | 52/211 |
| 6,688,045 | B1 | * | 2/2004 | Pilcher | 52/12 |
| 6,883,288 | B1 | * | 4/2005 | Harbin | 52/521 |
| 6,904,718 | B2 | * | 6/2005 | Fox | 52/12 |

(Continued)

FOREIGN PATENT DOCUMENTS

| | | | |
|---|---|---|---|
| JP | 05209450 | A * | 8/1993 |

*Primary Examiner*—Brian E Glessner
*Assistant Examiner*—James J Buckle, Jr.
(74) *Attorney, Agent, or Firm*—Young Basile

(57) ABSTRACT

An eaves trough for receiving water from a structure includes an elongated sheet that extends along a longitudinal axis and extends integrally from a first longitudinal edge to a second longitudinal edge. An upper portion of the sheet at least partially overlies the structure and extends from the first longitudinal edge to a longitudinal transition. A lower portion of the sheet extends from the longitudinal transition to the second longitudinal edge. The lower portion of the sheet extends generally downward from the upper portion of the sheet at the longitudinal transition and extends under at least part of the upper portion of the sheet, such that the lower portion of the sheet defines a trough below the upper portion of the sheet. Apertures are formed through the upper portion of the sheet such that the apertures overlie the trough. The water travels from the structure onto the upper portion of the sheet and through the apertures to the trough.

19 Claims, 9 Drawing Sheets

U.S. PATENT DOCUMENTS 6,988,335 B2 * 1/2006 Eyers ..... 52/12
7,424,795 B2 * 9/2008 Baxter et al. ..... 52/718.02
2003/0037495 A1 * 2/2003 Shaw ..... 52/287.1

* cited by examiner

EAVES TROUGH

FIELD OF THE INVENTION

The invention relates to the field of eaves troughs, and more particularly, to an eaves trough having a cover portion to prevent debris from entering the eaves trough.

BACKGROUND OF THE INVENTION

It is well known that eaves troughs tend to collect leaves and other debris and thus must be cleaned at regular intervals to prevent clogging. Numerous designs have been previously proposed to prevent debris from entering an eaves trough. Generally, these designs fall into one of two categories. Eaves troughs of the first category of designs include an impervious cap that extends completely over the eaves trough. The caps of such eaves troughs typically include a geometrical feature on the outboard end thereof, such as a semi-circular lip, that directs water into the eaves trough but prevents entry of leaves or other debris. The second category of designs regards screens that are attachable to the top surface of the eaves trough or insertable into the eaves trough, wherein the screen allows water to flow therethrough but prevents leaves or debris from entering the eaves trough.

It is well-known that so-called seamless gutters may be fabricated at the job site from a coil of stock material using a machine that bends the material to a desired cross-sectional shape. However, providing a cap or screen for the eaves trough conventionally requires a separate fabrication step, as well as a separate installation step, which often includes the use of hardware that is separate from the hardware used to hang the eaves trough itself. Accordingly, a need remains for an eaves trough that prevents the entry of leaves or other debris without requiring complicated fabrication and installation procedures.

SUMMARY OF THE INVENTION

In accordance with one embodiment of the invention, the invention provides an eaves trough for receiving water from a structure. The eaves trough includes an elongated sheet that extends along a longitudinal axis and extends integrally from a first longitudinal edge to a second longitudinal edge. The sheet includes an upper portion that extends from the first longitudinal edge to a longitudinal transition. The sheet also includes a lower portion that extends from the longitudinal transition to the second longitudinal edge. The upper portion of the sheet at least partially overlies the structure. The lower portion of the sheet extends generally downward from the upper portion of the sheet at the longitudinal transition and extends under at least part of the upper portion of the sheet, such that the lower portion of the sheet defines a trough below the upper portion of the sheet. A plurality of apertures is formed through the upper portion of the sheet such that the apertures overlie the trough. The water travels from the structure onto the upper portion of the sheet and through the apertures to the trough.

The eaves trough may include an upper fastening structure that connects the upper portion of the sheet to the structure and a lower fastening structure that connects the lower portion of the sheet to the structure. Either or both of the upper and lower fastening structures may include a longitudinally extending first channel member that is connected to the structure and an engaging member that is disposed on the sheet for releasably engaging the channel member to releasably secure the sheet to the structure. Alternatively, either of the upper and lower fastening structures may include a plurality of fasteners that extend through the sheet.

The eaves trough may include a plurality of water-guiding members that are disposed on the upper portion of the sheet, wherein each water guiding member is adjacent to a respective aperture of the plurality of apertures to direct water into the respective aperture. Furthermore, a water flow path may be defined along the upper portion of the sheet substantially perpendicular to the longitudinal axis thereof, wherein each aperture is elongated and extends along an axis that forms an acute angle with the water flow path. Additionally, each aperture may have an upstream edge and a downstream edge with respect to the water flow path, where a water-guiding member extends at least partially upward from the upper portion of the sheet along the downstream edge of each aperture of the plurality of apertures to direct water into a respective aperture. Additionally, the apertures can be aligned in a side-by-side fashion along the longitudinal axis of the sheet.

The lower portion of the sheet may be substantially arcuate and may extend inward from the longitudinal transition toward the structure. The upper portion of the sheet may be substantially planar. Furthermore, the upper portion of the sheet may extend at an angle of about 90° with respect to the lower portion of the sheet at the longitudinal transition. The longitudinal transition could comprise a bend, a curve, or a flexible hinge.

BRIEF DESCRIPTION OF THE DRAWINGS

The description herein makes reference to the accompanying drawings wherein like referenced numerals refer to like parts throughout several views and wherein.

DESCRIPTION OF THE PREFERRED EMBODIMENT

Figure 1:
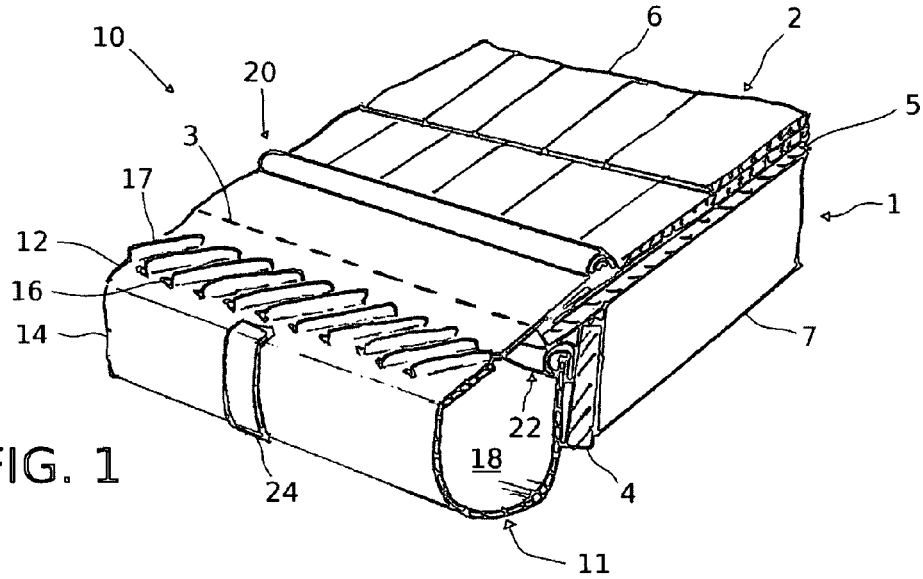
FIG. 1 is a perspective view showing an eaves trough according to the invention connected to a structure.

Referring to the drawings, the present invention will now be described in detail with reference to the disclosed embodiment.

Figure 2:
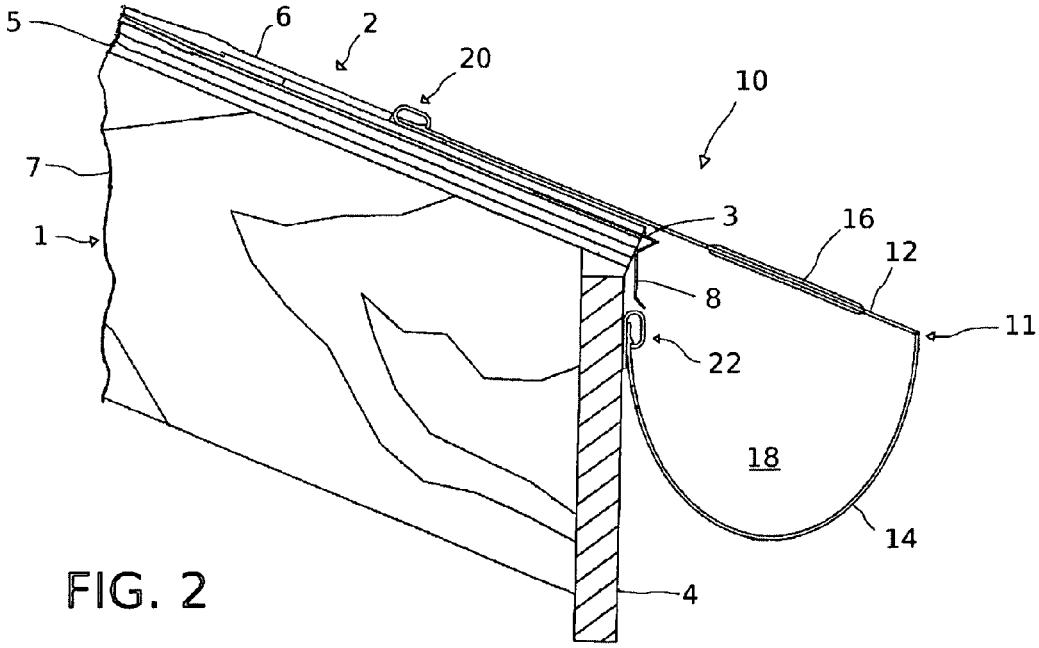
FIG. 2 is a side cross-section view showing the eaves trough connected to a structure.

FIGS. 1-2 show an eaves trough 10 according to the invention for receiving water from a structure 1. The eaves trough 10 is connectable to the structure 1, which may include a downwardly-sloping roof surface 2 having a terminal edge 3 and a fascia 4 that extends generally downward from the roof surface 2 near the terminal edge 3 thereof. The roof surface 2 could be constructed from a decking 5, such as plywood, and a plurality of shingles 6 that are disposed on the decking 5 in a layered fashion. Furthermore, the roof surface 2 may include a drip edge 8 that is typically installed between the decking 5 and the shingles 6 to direct water from the shingles 6 into the eaves trough 10. The roof surface 2 and the fascia 4 may be supported by a plurality of beams or trusses 7. However, it should be understood that the particular details of the structure 1 are included herein for explanatory purposes only and that the eaves trough 10 may be used in conjunction with various structures 1 for receiving water therefrom.

As will be explained in detail herein, the eaves trough 10 includes a body 11, an upper fastening structure 20, and a lower fastening structure 22. The body 11 can be fabricated from an elongate sheet material, such as steel or aluminum or vinyl, and is provided with a cross-sectional shape that defines an upper portion 12 of the body 11 and a lower portion 14 of the body 11 that each extend a long a longitudinal axis of the body 11. A plurality of apertures 16 are formed through the upper portion 12 of the body 11 so that water may flow from the roof surface 2 of the structure 1 onto the upper portion 12 of the body 11 of the eaves trough 10 and through the apertures 16 to a trough 18 that is defined by the lower portion 14 of the body 11 of the eaves trough 10. The upper fastening structure 20 connects the upper portion 12 of the body 11 of the eaves trough 10 to the structure 1, and the lower fastening structure 22 connects the lower portion 14 of the body 11 of the eaves trough 10 to the structure 1. Optionally, hanger assemblies 24 may also be provided to support the eaves trough 10 with respect to the structure 1.

Figure 3:
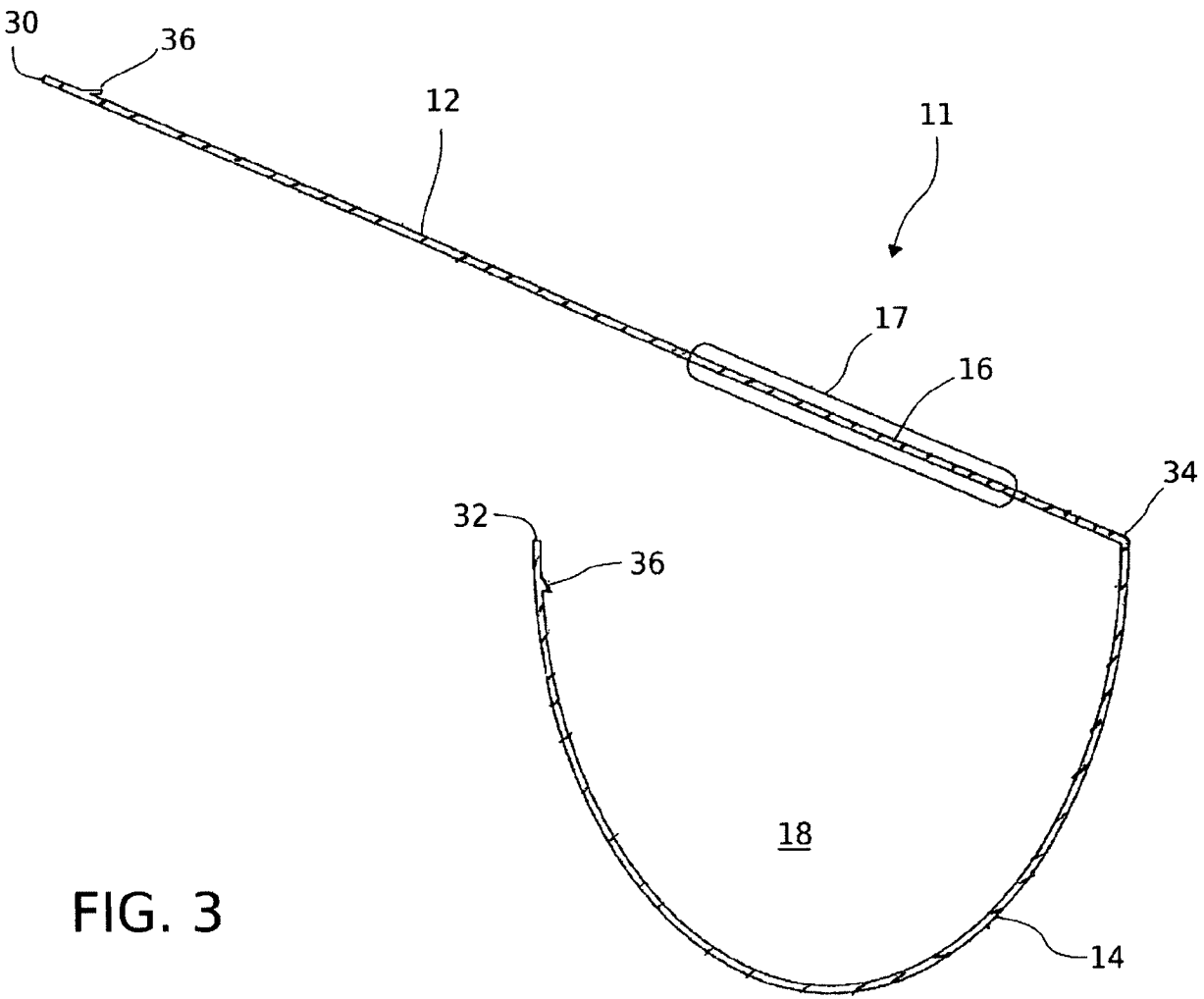
FIG. 3 is a side cross-section view showing a body of the eaves trough.

As best seen in FIG. 3, the body 11 extends integrally from a first longitudinal edge 30 to a second longitudinal edge 32. The upper portion 12 of the body 11 is defined between the first longitudinal edge 30 of the body 11 and a longitudinal transition 34 of the body 11. The lower portion 14 of the body 11 extends from the second longitudinal edge 32 of the body 11 to the longitudinal transition 34 of the body 11. The longitudinal transition 34 is a geometric feature that extends longitudinally along the body 11. For example, the longitudinal transition 34 could be a bend or a curve formed along the body 11 where the upper portion 12 of the body 11 meets the lower portion 14 of the body 11 at an angle, for example, a 90° angle. As another example, with particular regard to a body 11 that is fabricated from vinyl, the longitudinal transition 34 could be a flexible hinge that is formed by reducing the cross-sectional thickness of the body 11 along the longitudinal transition 34.

The upper portion 12 of the body 11 is geometrically configured so that it may receive rainwater from the roof surface 2. Accordingly, the upper portion 12 of the body 11 could be substantially planar. Furthermore, the apertures 16 and their associated water guiding members 17 can be formed on the upper portion 12 of the body 11 such that they substantially overlie the trough 18 that is formed by the lower portion 14 of the body 11.

The lower portion 14 of the body 11 is geometrically configured to form the trough 18 underneath at least a portion of the upper portion 12 of the body 11. In particular, the trough 18 may be directly beneath the apertures 16. The lower portion 12 of the body 11 extends generally downward from the upper portion 12 of the body 11 at the longitudinal transition 34. When the eaves trough 10 is installed with respect to the structure 1, the lower portion 14 of the body 11 can extend generally inward from the longitudinal transition 34 of the body 11 toward the structure 1, such that the second longitudinal edge 32 of the body 11 is adjacent to or in engagement with the fascia 4 or another portion of the structure 1. The lower portion 14 of the body 11 may have a substantially arcuate cross section or a substantially rectangular cross section.

Figure 4:
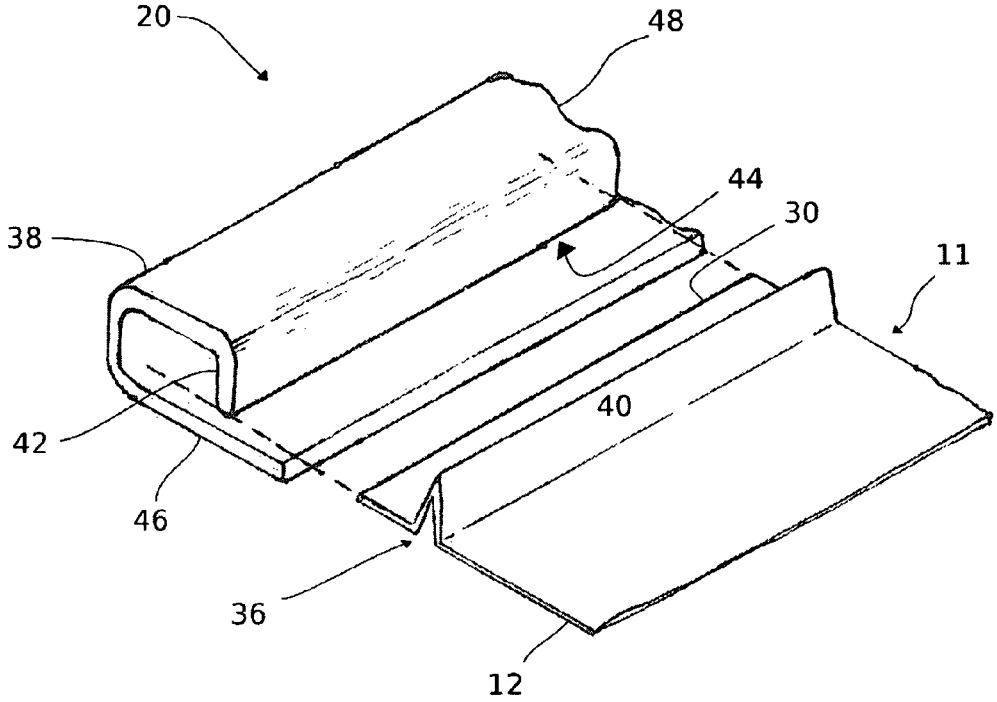
FIG. 4 is a perspective view showing a fastening structure.

The upper fastening structure 20 and the lower fastening structure 22 may each include an engaging member 36 that is formed integrally with the body 11 and a channel member 38, as shown in FIG. 4, wherein the upper fastening structure 20 is shown as representative of both the upper fastening structure 20 and the lower fastening structure 22. The channel member 38 may be any device that is connectable to the structure 1 with which the engaging member 36 can be releasably engaged to connect the body 11 to the structure 1. The engaging member 36 may be fabricated as a fold in the body 11 that creates a longitudinally-extending shoulder 40 that is engageable with a longitudinally-extending interior surface 42 of the channel member 38 that is adjacent to a longitudinal opening 44 of the channel member 38. To define the opening 44, the channel member 38 includes a substantially planar base portion 46 and a C-shaped portion 48 that is resiliently connected to the base portion 46 opposite the opening 44. Thus, the engaging member 36 may be inserted into the channel member 38 by resiliently bending the C-shaped portion 48 of the channel member 38 to widen the opening 44 and then sliding the engaging member 36 through the opening 44. Once the engaging member 36 is disposed within the channel member 38, the shoulder 40 engages the interior surface 42 of the channel to prevent removal of the body 11 from the channel member 38.

Figure 5:
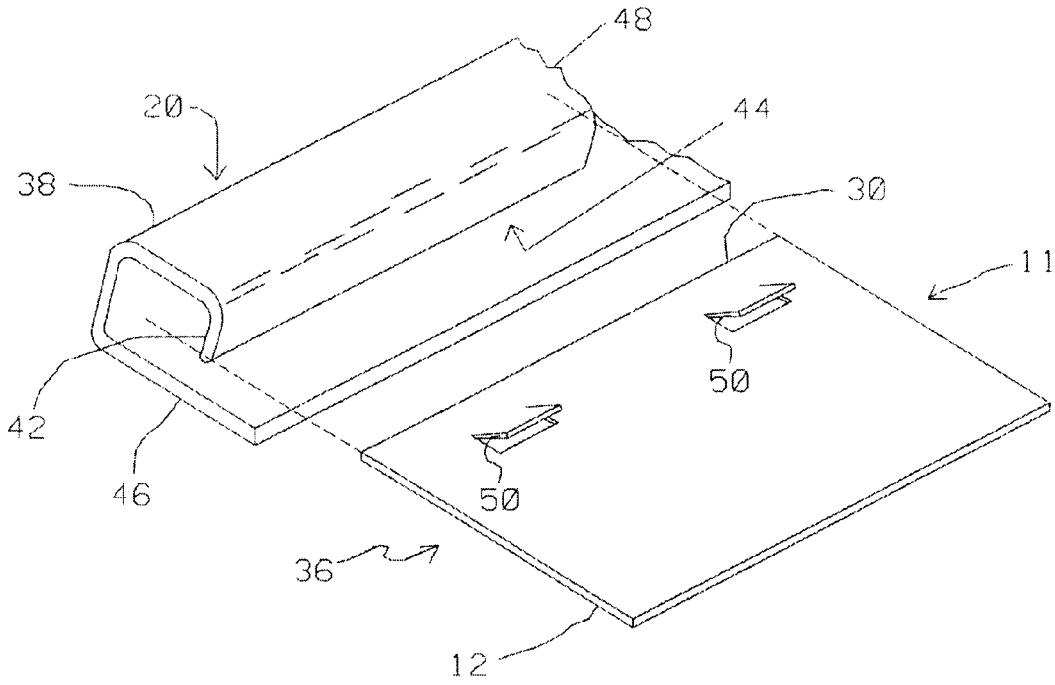
FIG. 5 is a perspective view showing an alternative fastening structure.
Figure 10:
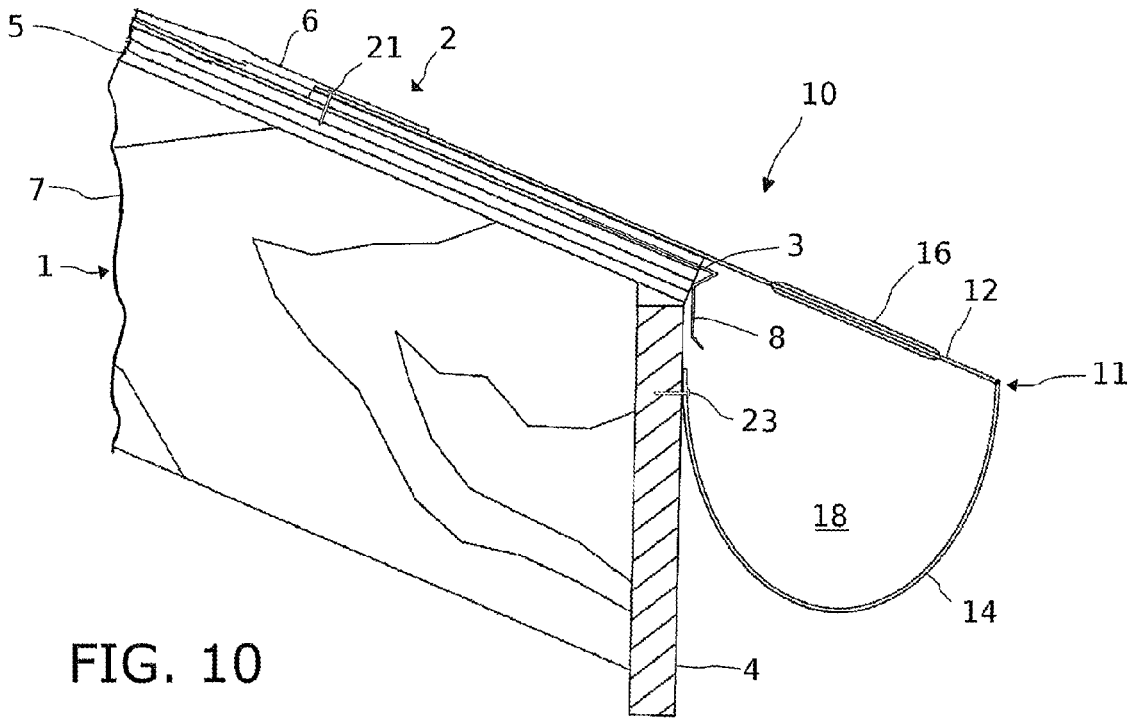
FIG. 10 is a side cross-section view showing the eaves trough connected to a structure using nails.

It should be understood that various structures could be employed as the upper fastening structure 20 and the lower fastening structure 22. For example, the engaging member 36 may include a plurality of generally upstanding tabs 50 that are formed integrally with the body 11, as shown in FIG. 5. The tabs 50 may be fabricated by punching and folding the body 11, or by other suitable methods. As a further alternative, the upper fastening structure 20 and the lower fastening structure 22 could include conventional fasteners, such as nails 22, 23 that connect the body 11 directly to the structure, thereby omitting the channel member 38, as shown in FIG. 10. For example, the first longitudinal edge 30 of the body 11 could be disposed underneath a portion of the shingles 6 of the roof surface 2 and connected to the roof surface 2 by nails 22.

Figure 6:
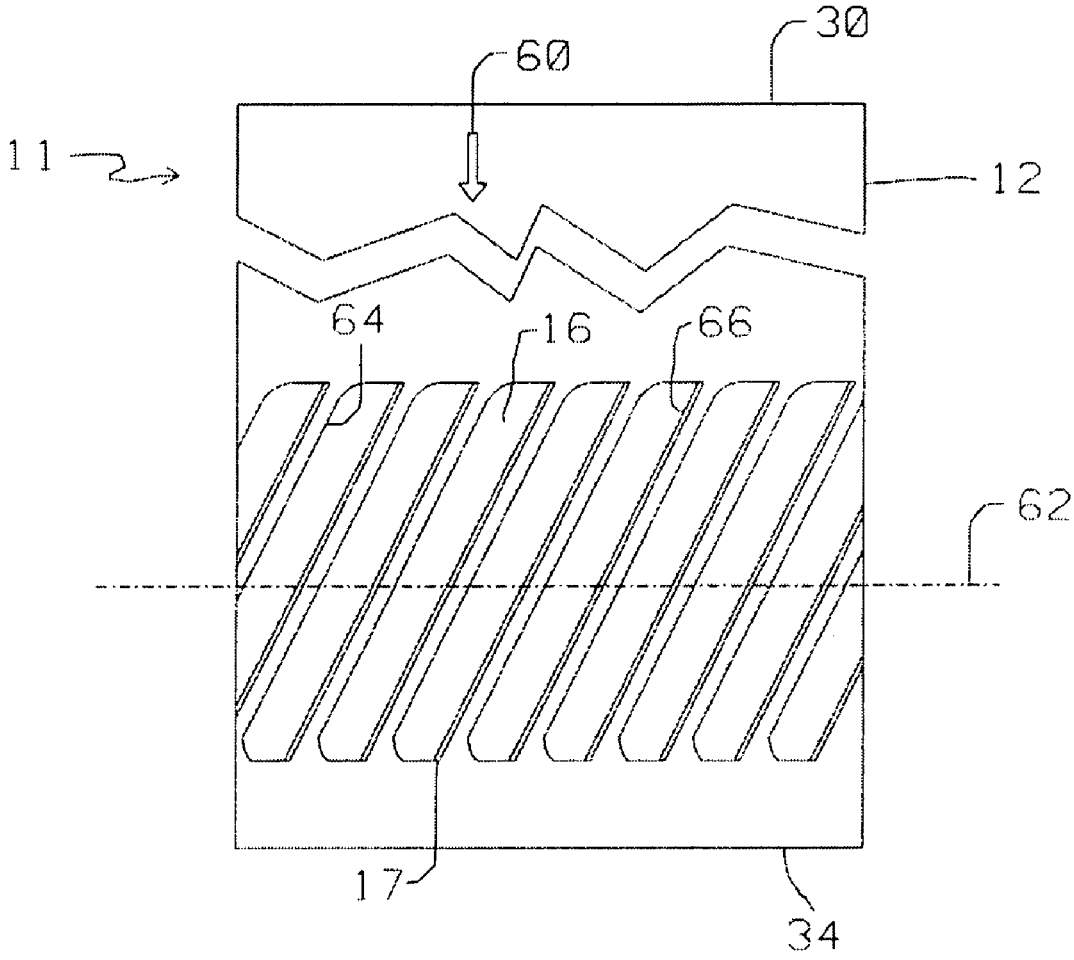
FIG. 6 is a top view showing a plurality of apertures and water-guiding members of the body.

In order to direct rainwater into the trough 18 that is formed by the lower portion 14 of the body 11 of the eaves trough 10, the apertures 16 are provided through the upper portion 12 of the eaves trough 10. As best seen in FIG. 6, a water flow path 60 is defined along the upper portion 12 of the body 11 substantially perpendicular to a longitudinal axis 62 of the body 11. The apertures 16 are elongated and extend at an acute angle with respect to the water flow path 60. For example, the apertures 16 may extend at an angle of between 15° and 75° with respect to the water flow path 60. Furthermore, the apertures may include an elongated upstream edge 64 and an elongated downstream edge 66, wherein the upstream edge 64 is located upstream of the downstream edge 66 with respect to the water flow path 60. Furthermore, the apertures 16 may be aligned in a side-by-side fashion along the longitudinal axis 62 of the body 11, such that the upstream edge 64 of one of the apertures 16 is adjacent to the downstream edge 66 of an adjacent aperture 16.

Figure 7:
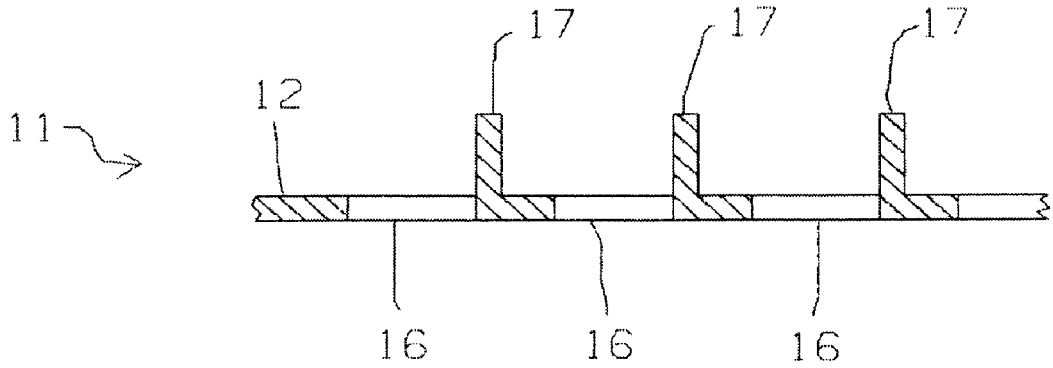
FIG. 7 is a cross-section view of the apertures and water-guiding members shown in FIG. 6.
Figure 8:
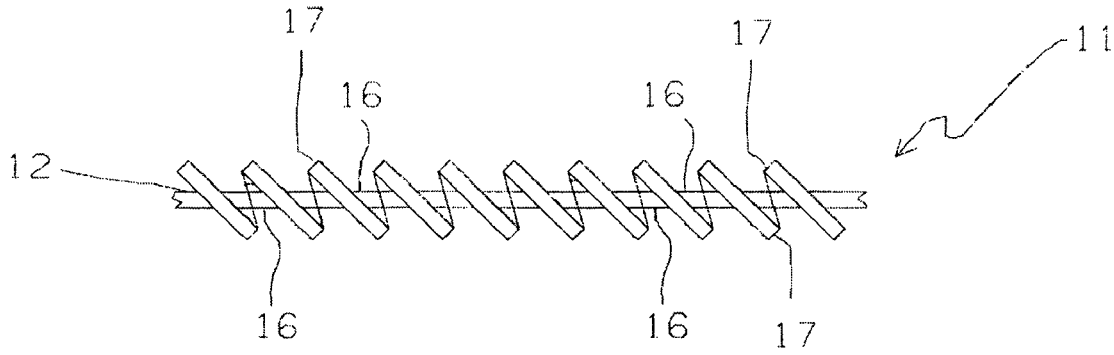
FIG. 8 is a cross section view showing alternative apertures and water-guiding members.

In order to direct water into the apertures 16, the water-guiding members 17 may be provided adjacent to the apertures 16. As shown in FIG. 7, the water-guiding members 17 may each extend upward from the upper portion 12 of the body 11 along the downstream edge 66 of each aperture 16. The water-guiding members 17 may be formed integrally with the upper portion 12 of the body 11, for example, by fabricating the water-guiding members 17 through a punching and bending operation, wherein a three-sided cut is made into the upper portion 12 of the body 11, and the material bounded by the three-sided cut is folded with respect to the generally planar top surface of the upper portion 12 to provide the water-guiding member 17. Alternatively, as shown in FIG. 8, the water-guiding members 17 may be formed integrally with the upper portion 12 of the body 11 by fabricating the water-guiding member 17 in a louver-like fashion, wherein the water-guiding members 17 extend at least partially upward from the upper portion 12 of the body 11, as well as at least partially downward from the upper portion 12 of the body 11. In particular, the water-guiding member 17 may be fabricated from a punching and folding operation, wherein a series of parallel slits are formed through the upper portion 12 of the body 11 and the intervening material between the slits is twisted with respect to the upper portion 12 of the body 11 to provide the water-guiding members 17.

Figure 9:
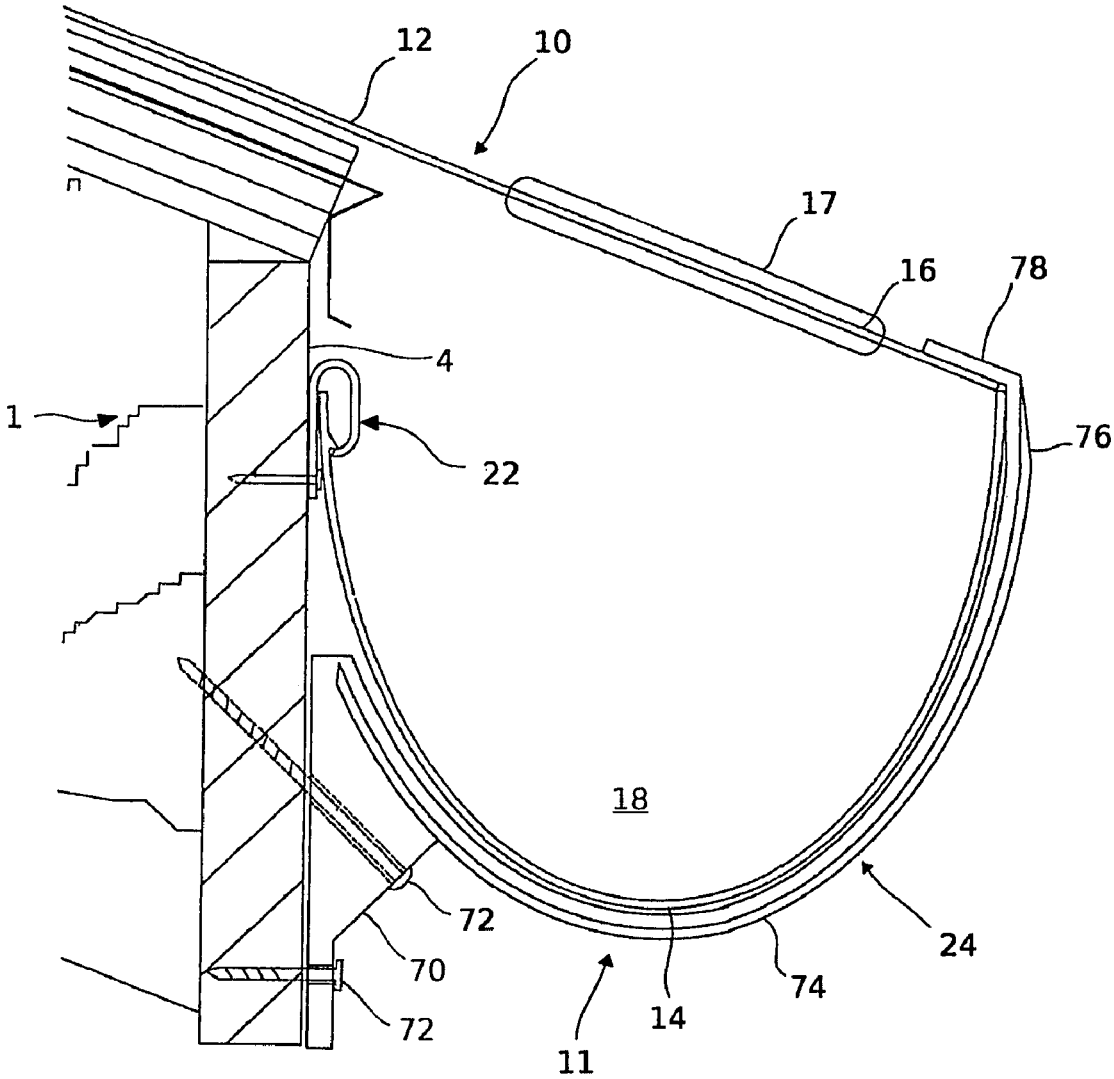
FIG. 9 is a side cross-section view showing the eaves trough connected to a structure, wherein the eaves trough is supported by hanger assemblies.

As shown in FIG. 9, the eaves trough 10 may include the hanger assemblies 24 to provide additional support to the body 11. Each hanger assembly 24 includes a base member 70 that is connected to the structure 1. For example, the base member 70 may be attached to the fascia 4 of the structure 1 by fasteners 72, such as nails or screws. The base member 70 is located below the lower fastening structure 22, and a support arm 74 is connected to the base member 70 is a cantilevered fashion such that the support arm 74 extends generally outward from the structure 1. The support arm 74 is contoured to complementarily engage the lower portion 14 of the body 11, and thus may be substantially arcuate. Furthermore, a retainer 78 may be provided at the outer end 76 of the support arm 74 to engage the upper portion 12 of the body 11, to restrain the body 11 from moving upward with respect to the hanger assembly 24. The retainer 78 may be a flange that is formed integrally with the support arm 74 and that extends generally toward the structure 1 from the outer end 76 of the support arm 74.

In use, the body 11 of the eaves trough may be fabricated from a stock material, such as steel, aluminum, or vinyl, by bending or folding operations, as well as punching operations. A user installs the eaves trough 10 by connecting the upper fastening structure 20 and the lower fastening structure 22 to the structure 1, and connecting the body 11 to the upper fastening structure 20 and the lower fastening structure 22. The user may optionally install the hanger assemblies 24 to provide additional support for the body 11. Furthermore, the body 11 may be mounted with a slight longitudinal drop toward an outflow pipe (not shown). During a storm, rain water travels from the roof surface 2 of the structure 1 onto the top portion 12 of the body 11. The rain water is then directed into the apertures 16 by the water guiding members 17, and drops into the trough 18 that is formed by the lower portion 14 of the body 11.

While the invention has been described in connection with what is presently considered to be the most practical and preferred embodiment, it is to be understood that the invention is not to be limited to the disclosed embodiments, but to the contrary, it is intended to cover various modifications or equivalent arrangements included within the spirit and scope of the appended claims. The scope is to be accorded the broadest interpretation so as to encompass all such modifications and equivalent structures as is permitted under the law.

What is claimed is:

1. An eaves trough for receiving water from a structure, comprising:

an elongated sheet that extends along a longitudinal axis and extends integrally from a first longitudinal edge to a second longitudinal edge;

the sheet having an upper portion that extends from the first longitudinal edge to a longitudinal transition, wherein the upper portion is planar and at least partially overlies the structure;

the sheet having a lower portion that extends from the longitudinal transition to the second longitudinal edge, the lower portion extending at an angle with respect to the upper portion, such that the lower portion extends downward from the upper portion and toward the structure from the longitudinal transition and extends under at least part of the upper portion of the sheet, such that the lower portion defines a trough below the upper portion of the sheet, the trough extending from the longitudinal transition to the second longitudinal edge of the sheet; and a plurality of apertures formed through the upper portion of the sheet such that the apertures overlie the trough, wherein the water travels from the structure onto the upper portion of the sheet and through the apertures to the trough; and an upper fastening structure that connects the upper portion of the sheet to the structure, wherein the upper fastening structure having a longitudinally extending first channel member that is connected to the structure and an upper engaging member disposed on the upper portion of the sheet near the first longitudinal edge thereof, the upper engaging member releasably engageable with the first channel member to releasably secure the first longitudinal edge of the sheet to the structure.

2. The eaves trough stated in claim 1, further comprising:

a lower fastening structure that connects the lower portion of the sheet to the structure.

3. The eaves trough stated in claim 1, further comprising:

a bracket that is connected to the structure adjacent to the second longitudinal edge of the sheet, the bracket having a first portion that extends generally outward from the structure to support the lower portion of the sheet and is shaped complementarily to the lower portion of the sheet, and a second portion that extends generally inward toward the structure and is in engagement with the upper portion of the sheet to restrain the sheet from moving upward with respect to the bracket, wherein the first portion of the bracket meets the second portion of the bracket adjacent to the longitudinal transition.

4. The eaves trough stated in claim 1, further comprising:

a plurality of substantially planar water guiding members disposed on the upper portion of the sheet and extending upward therefrom, wherein each water guiding member is adjacent to a respective aperture of the plurality of apertures and extends substantially perpendicular to the upper portion of the sheet to direct the water into the respective aperture.

5. The eaves trough stated in claim 1, further comprising:

a water flow path defined along the upper portion of the sheet substantially perpendicular to a longitudinal axis thereof, wherein each aperture is elongated and extends along an axis that forms an acute angle with the water flow path.

6. The eaves trough stated in claim 1, wherein the lower portion of the sheet is substantially arcuate, and extends inward from the longitudinal transition toward the structure.

7. The eaves trough stated in claim 1, wherein the upper portion of the sheet extends at an angle of about 90 degrees with respect to the lower portion of the sheet at the longitudinal transition.

8. The eaves trough stated in claim 1, wherein the sheet is fabricated from vinyl and the longitudinal transition is defined by a flexible hinge that is formed by reducing a cross-sectional thickness of the sheet along the longitudinal transition.

9. The eaves trough stated in claim 2, further comprising:

the lower fastening structure having a longitudinally extending second channel member that is connected to the structure and a lower engaging member disposed on the lower portion of the sheet near the second longitudinal edge thereof, the lower engaging member releasably engageable with the second channel member to releasably secure the second longitudinal edge of the sheet to the structure.

10. The eaves trough stated in claim 2, further comprising:

the upper fastening structure having a plurality of fasteners that extend through the upper portion of the sheet; and the lower fastening structure having a plurality of fasteners that extend through the lower portion of the sheet.

11. The eaves trough stated in claim 2, wherein no portion of the structure overlies the first channel member.

12. The eaves trough stated in claim 5, further comprising:

each aperture having an upstream edge and a downstream edge with respect to the water flow path; and a plurality of substantially planar water guiding members each extending at least partially upward from the upper portion of the sheet along the downstream edge of a respective aperture of the plurality of apertures to direct the water into the respective aperture, the water guiding members extending substantially perpendicular to the upper portion of the sheet.

13. The eaves trough stated in claim 5, further comprising:

the apertures of the plurality of apertures aligned in a side-by-side fashion along the longitudinal axis of the sheet.

14. An eaves trough for receiving water from a structure that includes a downwardly sloping roof surface having a terminal edge and a fascia that extends generally downward from the roof surface near the terminal edge of the roof surface, the eaves trough comprising:

an elongated sheet that extends along a longitudinal axis and extends integrally from a first longitudinal edge to a second longitudinal edge;

the sheet having an upper portion that extends from the first longitudinal edge to a longitudinal transition, wherein the upper portion is planar, extends substantially coplanar to the roof surface, and at least partially overlies the roof surface;

the sheet having a lower portion that extends from the longitudinal transition to the second longitudinal edge, the lower portion extending at an angle with respect to the upper portion, such that the lower portion extends generally downward from the upper portion and toward the fascia from the longitudinal transition and extends under at least part of the upper portion of the sheet, such that the lower portion defines a substantially U-shaped trough below the upper portion of the sheet, the U-shaped trough extending from the longitudinal transition to the second longitudinal edge of the sheet;

an upper fastening structure that connects the upper portion of the sheet to the roofsurface;

a lower fastening structure that connects the lower portion of the sheet to the roof fascia; and a plurality of apertures formed through the upper portion of the sheet such that the apertures overlie the trough, wherein the water travels from the roof surface onto the upper portion of the sheet and through the apertures to the trough; and the upper fastening structure having a longitudinally extending first channel member that is disposed on the roof surface of the structure and is connected thereto, and an upper engaging member disposed on the upper portion of the sheet near the first longitudinal edge thereof, the upper engaging member releasably engageable with the first channel member to releasably secure the first longitudinal edge of the sheet to the structure.

15. The eaves trough stated in claim 14, further comprising:

the lower fastening structure having a longitudinally extending second channel member that is connected to the fascia of the_structure and a lower engaging member disposed on the lower portion of the sheet near the second longitudinal edge thereof, the lower engaging member releasably engageable with the second channel member to releasably secure the second longitudinal edge of the sheet to the structure.

16. The eaves trough stated in claim 14, further comprising:

a water flow path defined along the upper portion of the sheet substantially perpendicular to the longitudinal axis thereof, wherein each aperture is elongated and extends along an axis that forms an acute angle with the water flow path; and each aperture having an upstream edge and a downstream edge with respect to the water flow path; and a plurality of substantially planar water guiding members each extending at least partially upward from the upper portion of the sheet along the downstream edge of a respective aperture of the plurality of apertures to direct water into the respective aperture, the water guiding members extending substantially perpendicular to the upper portion of the sheet.

17. The eaves trough stated in claim 14, wherein the sheet is fabricated from vinyl and the longitudinal transition is defined by a flexible hinge that is formed by reducing a cross-sectional thickness of the sheet along the longitudinal transition.

18. The eaves trough stated in claim 15, wherein no portion of the roof surface overlies the first channel member.

19. An eaves trough for receiving water from a structure that includes a downwardly sloping roof surface having a terminal edge and a fascia that extends generally downward from the roof surface near the terminal edge of the roof surface, the eaves trough comprising:

an elongated sheet that extends along a longitudinal axis and extends integrally from a first longitudinal edge to a second longitudinal edge;

the sheet having a substantially planar upper portion that extends from the first longitudinal edge to a longitudinal transition, wherein the upper portion extends substantially coplanar to the roof surface, and at least partially overlies the roof surface;

the sheet having a substantially arcuate lower portion that extends from the longitudinal transition to the second longitudinal edge, the lower portion extending at an angle with respect to the upper portion, such that the lower portion extends downward from the upper portion and toward the structure from the longitudinal transition and extends under at least part of the upper portion of the sheet, such that the lower portion defines a substantially u-shaped trough below the upper portion of the sheet, the U-shaped trough extending from the longitudinal transition to the second longitudinal edge of the sheet;

an upper fastening structure that connects the upper portion of the sheet to the roof surface, the upper fastening structure having a longitudinally extending first channel member that is disposed on the roof surface of the structure and is connected thereto, and an upper engaging member disposed on the upper portion of the sheet near the first longitudinal edge thereof, the upper engaging member releasably engageable with the first channel member to releasably secure the first longitudinal edge of the sheet to the structure;

a lower fastening structure that connects the lower portion of the sheet to the fascia of the structure, the lower fastening structure having a longitudinally extending second channel member that is connected to the fascia of the structure and a lower engaging member disposed on the lower portion of the sheet near the second longitudinal edge thereof, the lower engaging member releasably engageable with the second channel member to releasably secure the second longitudinal edge of the sheet to the structure;

a water flow path defined along the upper portion of the sheet substantially perpendicular to the longitudinal axis thereof; and a plurality of elongated apertures formed through the upper portion of the sheet and aligned in a side-by-side fashion along the longitudinal axis of the sheet such that the apertures overlie the trough, each aperture extending along an axis that forms an acute angle with the water flow path such that each aperture has an upstream edge and a downstream edge with respect to the water flow path, wherein a plurality of water guiding members are formed integrally with the upper portion of the sheet and extend at least partially upward from the upper portion of the sheet along the downstream edge of each aperture so that the water travels from the roof surface onto the upper portion of the sheet and is direct directed through the apertures to the trough by the water guiding members.

* * * * *